United States Patent [19]

Ohmura et al.

[11] Patent Number: 4,911,099

[45] Date of Patent: Mar. 27, 1990

[54] PAINTING SYSTEM FOR PAINTING FINNED-TUBE HEAT EXCHANGER

[75] Inventors: Hiroshi Ohmura; Isao Adachi, both of Hadano, Japan

[73] Assignee: Toyo Radiator Co., Ltd., Tokyo, Japan

[21] Appl. No.: 328,982

[22] Filed: Mar. 27, 1989

[51] Int. Cl.[4] ..... B05B 5/02

[52] U.S. Cl. ..... 118/626; 118/64; 118/314; 118/322; 118/326; 118/501; 118/631

[58] Field of Search ..... 118/63, 64, 313, 314, 118/321, 322, 326, 501, 626, 631

[56] References Cited

U.S. PATENT DOCUMENTS

| | | | |
|---|---|---|---|
| 1,710,953 | 4/1929 | Sullivan | 118/64 |
| 2,754,226 | 7/1956 | Juvinall | 118/626 |
| 4,181,093 | 1/1980 | Tredwell | 118/326 |

*Primary Examiner*—Bernard Nozick
*Attorney, Agent, or Firm*—Sughrue, Mion, Zinn, Macpeak & Seas

[57] ABSTRACT

A painting system for painting a finned-tube heat exchanger suspended from a conveyor line so as to be conveyed thereby, comprises: (i) means for spraying on said heat exchanger with a water-soluble paint; (ii) means for air-blowing on said heat exchanger; and (iii) means for electrostatic spraying on said heat exchanger with a solvent-soluble paint. Each of spray nozzle assemblies and air-blow nozzle assemblies of said means issues paint spray or air blow to fins of said heat exchanger in a direction parallel to said fins. This painting system further comprises a scraper means for recovering said water-soluble paint sprayed and reached a wall member during spraying and air blow.

3 Claims, 5 Drawing Sheets

PAINTING SYSTEM FOR PAINTING FINNED-TUBE HEAT EXCHANGER

BACKGROUND OF THE INVENTION

1. Field of the Invention:

The present invention relates to a painting system for painting a finned-tube heat exchanger, and more particularly to a painting system for painting a heat exchanger provided with a plurality of fins such as plate fins and corrugated fins so as to uniformly and efficiently paint even a root portion of each of the fins which are so mounted in the heat exchanger as to be closely spaced apart from each other.

2. Description of the Prior Art:

In heat exchangers employed in engines for automobiles, marine ships and construction equipments, or employed in air-conditioning equipments, a plurality of fins are so mounted on tubes as to be closely spaced in parallel apart from each other, through which tubes the heat-exchanger fluid flows. These heat exchangers are generally painted to improve its rust resistance or corrosion resistance and appearance.

In a conventional painting system for painting the heat exchangers, the heat exchangers are suspended from a suitable conveyor line such as one constructed of a conveyor chain, and transferred to a painting zone in which a solvent-soluble paint is sprayed on the heat exchangers in parallel to the fins thereof.

However, in such conventional painting system, since the plurality of the fins of the heat exchanger to be painted are so mounted on the tubes as to be closely spaced in parallel apart from each other, it is very difficult to uniformly paint a root portion of each of the fins and outer peripheral surfaces of the tubes. Consequently, the conventional painting system is not adequate to spray painting of finned-tube heat exchangers which are used under severe conditions, and, therefore required to be good in rust resistance or corrosion resistance.

SUMMARY OF THE INVENTION

It is an object of the present invention to provide a novel painting system for painting a finned-tube heat exchanger, which system is free from the disadvantages inherent in the conventional painting system.

It is another object of the present invention to provide a painting system for painting a finned-tube heat exchanger, in which system a paint is so sprayed on the heat exchanger as to uniformly and efficiently paint even a root portion of each of fins of the heat exchanger.

It is further another object of the present invention to provide a painting system for painting a finned-tube heat exchanger, which system is provided with a paint-recovering unit for recovering a water-soluble paint having been sprayed and adhered to a wall member of a painting zone of the system.

It is still further another object of the present invention to provide a painting system for painting a finned-tube heat exchanger, which system may paint opposite sides of the heat exchanger separately.

The above objects of the present invention are accomplished by providing:

A painting system for painting a finned-tube heat exchanger provided with a plurality of fins so mounted on tubes of said heat exchanger as to be closely spaced apart from each other, comprising:

(i) a conveyor line from which said heat exchanger is suspended so as to be conveyed by said conveyor line;

(ii) a first spray means provided with a first spray nozzle assembly for spraying a water-soluble paint on said fins of said heat exchanger in a direction parallel to said fins, which heat exchanger suspended from said conveyor line halts during spraying of said water-soluble paint;

(iii) an air-blow means provided with an air-blow nozzle assembly for driving a current of air upon said fins of said heat exchanger in a direction parallel to said fins, which heat exchanger having been sprayed with said water-soluble paint halts during driving of said current of air;

(iv) a second spray means provided with a second spray nozzle assembly for spraying a solvent-soluble paint on said fins of said heat exchanger in a direction parallel to said fins through electrostatic spraying, which heat exchanger having been blown with said current of air halts during spraying of said solvent-soluble paint;

(v) a wall means oppositely disposed from each of said first spray means and said air-blow means so as to receive said water-soluble paint having sprayed and passed through said heat exchanger; and (vi) a scraper means for scraping said water-soluble paint received by said wall means to recover said water-soluble paint.

Further additional objects, features and advantages of the present invention will become apparent hereinafter during the detailed description of a preferred embodiment of the present invention, which embodiment is illustrated by way of example in the accompanying drawings.

DESCRIPTION OF THE PREFERRED EMBODIMENT

Figure 1:
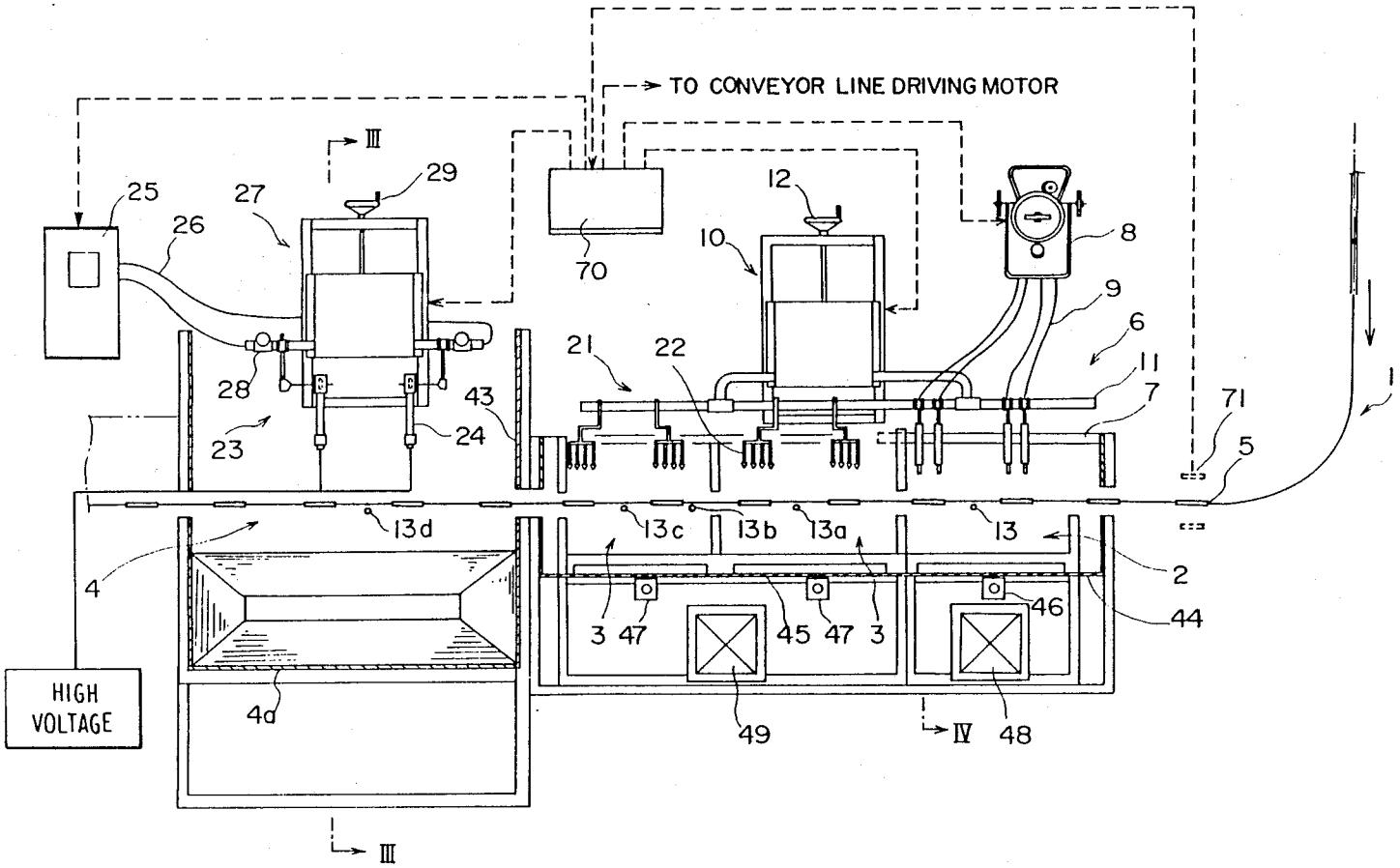
FIG. 1 is a schematic plan view of a preferred embodiment of a painting system of the present invention for painting a work of finned-tube heat exchanger.

Now, a preferred embodiment of a painting system of the present invention for painting a finned-tube heat exchanger will be described hereinbelow in detail with reference to the drawings in which:

The reference numeral 1 denotes a conveyor line; 2 a precoating zone; 3 an air-blow zone; 4 an electrostatic spraying zone; **4*a* a water-wash wall or wetted wall; 5 a heat exchanger; 6 a first spray means; 7 a first spray nozzle assembly; 8 an airless pump; 9 a paint hose; 10 a driving means; 11 a driving pipe; 12 a handle; 13, 13*a*, 13*b*, 13*c* and 13*d* rotating means; 14 an endless conveyor chain; 15 a work holder or suspending means; 16 a supporting member; 17 a rotating arm; 17' a top hook; 18 a work hook; 19 a supporting frame; 20 a roller; 21 an air-blow means; 22 an air-blow nozzle assembly; 23 a second spray means; 24 a second spray nozzle assembly; 25 an airless pump; 26 a paint hose; 27 a driving means; 28 a driving pipe; 29 a handle; 30 a base member; 31 a paint-recovering tank; 32 a traveling carriage; 33 a geared motor; 34 an endless chain; 35 an intermediate sprocket; 36 an upper sprocket; 37 an endless chain; 38 a supporting member; 39 a pin; 40 a guide rail; 41, 43, 44 and 45 wall members; 42 a guide bar; 46 and 47 scraper means; 48 and 49 ventilating ducts; 50 a driving unit; 51 a slit; 52 a rod; 53 a scraper; 54 a cylinder; 55 a piston; 56 an air-inlet opening; 57 a piston yoke; 58 a bolt; 59 an O-ring;; 60 an inner sealing band; 61 an outer sealing band; 62 a flange member; 64 and 65 flange portions; 63 a connecting member; 66 a rubber plate; 67 a metallic plate; 68 a supporting member; 69 a resilient sheet; 70 a control panel; 71 a sensor means; 72 a plate-fin tube heat exchanger; 73 a plate fin; 74 a flattened tube; 75 a corrugated-fin tube heat exchanger; 76 a corrugated fin; 77 a header; 78 a tank; 79 a water-soluble paint; and 80** a solvent-soluble paint.

Figure 11:
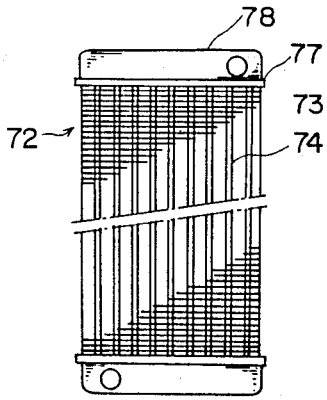
FIG. 11 is a perspective view of the heat exchanger of a plate-fin tube type to be painted in the painting system of the present invention.
Figure 12:
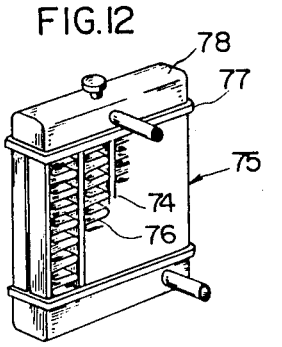
FIG. 12 is a perspective view of the heat exchanger of a corrugated-fin tube type to be painted in the painting system of the present invention.
Figure 12:
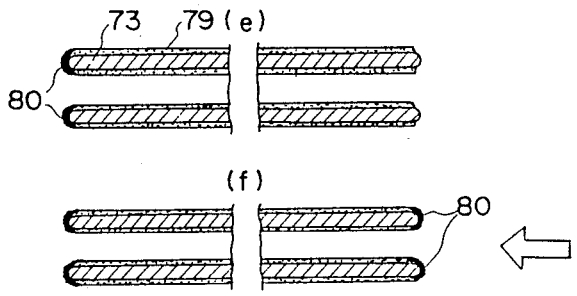

As shown in FIGS. 11 and 12, heat exchangers to be painted by a painting system of the present invention are conventional ones of the plate-fin tube type or of the corrugated-fin tube type.

The plate-fin tube heat exchanger 72 shown in FIG. 11 is essentially constructed of: a plurality of plate fins 73 closely spaced in parallel apart from each other; a plurality of flattened tubes 74 which are spaced in parallel apart from each other while disposed perpendicularly to the plate fins 73 so as to penetrate the fins 73; headers 77 to which opposite ends of each of the flattened tubes 74 are brazed hermetically; and tanks 78 a lower opening of each of which is hermetically closed by each of the headers 77. The plate fins 73 of such heat exchanger 72 are provided at intervals of from about 1 to about 5 mm. On the other hand, the corrugated-fin tube heat exchanger 75 shown in FIG. 12 is essentially constructed of: a plurality of flattened tubes 74 spaced in parallel apart from each other; a plurality of corrugated fins 76 each of which is so sandwiched between the flattened tubes 74 as to be bought into contact with the tubes 74 as its bight portions and brazed thereto at the portions; headers 77 to which opposite ends of each of the flattened tubes 74 are brazed hermetically; and tanks 78 a lower opening of each of which is hermetically closed by each of the headers 77. In general, the heat exchanger 72 or 75 is constructed of the tanks 78 and a tube-and-fin exchanger core which is assembled from the flattened tubes 74, fins 73 or 76 and the headers 77.

In the painting system of the present invention, the heat exchanger 72 or 75 itself, or its core forms the work 5 to be painted by spraying.

In any case, in the painting system of the present invention, one side of the work or heat exchanger is painted first, and secondly the other side of the heat exchanger is painted. Consequently, in the preferred embodiment of the present invention, the suspending means or work holder 15 suspended from the conveyor line 1 comprises the rotating arm 17 for turning the heat exchanger 5 or work 180° after one side of the work 5 is painted in a first painting zone, the other side of the work 5 being then painted in a second painting zone to make it possible to paint opposites sides of the work or heat exchanger 5.

As shown in FIG. 1, the conveyor line 1 of the painting system of the present invention may be constructed of an endless conveyor, preferably of endless conveyor chain driven intermittently by a suitable driving unit (not shown) in a direction indicated by an arrow in FIG. 1, so that the work or heat exchanger 5 suspended from the conveyor line 1 intermittently halts in each of the precoating zone 2, air-blow zone 3 and the electrostatic spraying zone 4.

As is clear from FIG. 1, the work or heat exchanger 5 suspended from the conveyor line 1 passes through sequentially: the precoating zone 2 provided with the first spray means 6 for spraying a water-soluble paint on the fins of the heat exchanger in a direction parallel to the fins, which heat exchanger 5 halts during spraying of the water-soluble paint; the air-blow zone 3 provided with the air-blow means 21 for driving a current of air upon the fins of the heat exchanger 5 in a direction parallel to the fins, which heat exchanger 5 having been sprayed with the water-soluble paint halts during driving of the current of air; and the electrostatic spraying zone provided with the second spray means 23 for spraying a solvent-soluble paint on the fins of the heat exchanger 5 in a direction parallel to the fins through electrostatic spraying, which heat exchanger 5 having been blown with the current of air halts during spraying of the solvent-soluble paint. After that, the heat exchanger 5 suspended from the conveyor line 1 enters a stoving zone (not shown) provided with a suitable stoving unit (not shown) for stoving the paints applied to the heat exchanger 5. After completion of stoving, the heat exchanger 5 coated with the paints is unloaded from the conveyor line 1 so as to be replaced with an unpainted heat exchanger 5, whereby the conveyor line 1, from which the unpainted heat exchanger 5 is suspended, returns to the precoating zone 2.

A plurality of the suspending means or work holders 15 are mounted on the conveyor line 1 at the same intervals as those of groups of the first spray nozzle assemblies 7 disposed in the precoating zone 2 and those of groups of the air-blow nozzle assemblies 22 disposed in the air-blow zone 3. Each of the heat exchangers 5 is suspended from each of the work holder 15. As described above, the heat exchanger 5 suspended from the work holder 15 passes through sequentially the precoating zone 2, air-blow zone 3 and the electrostatic spraying zone 4, and then enters the stoving zone (not shown) provided with the suitable stoving unit (not shown). Finally, the heat exchanger 5 coated with the paints having been stoved is unloaded from the work holder 15 suspended on the conveyor line 1.

In the painting system of the present invention, preferably, the heat exchanger 5 is so suspended from the conveyor line 1 as to keep its fins horizontal during spraying and air blowing. In the precoating zone 2, there is provided the first spray means 6 which is essentially constructed of: four first spray nozzle assemblies 7; an airless pump 8 for supplying the water-soluble paint to each of the first spray nozzle assemblies 7 (the airless pump 8 means a pump for discharging the water-soluble paint having no air); and a flexible paint hose 9 through which the airless pump 8 communicates with each of the first spray nozzle assemblies 7.

In the precoating zone 2, the four first spray nozzle assemblies 7 of the first spray means 6 are vertically reciprocated. Namely, each of the four first spray nozzle assemblies 7 is movably mounted on the driving pipe 11 of the driving means 10 through a suitable swivel joint so that these assemblies 7 can be vertically reciprocated when the driving pipe 11 is swingably operated in a vertical plane by the driving means 10. Incidentally, by turning the handle 12 of the driving means 10, it is possible to horizontally move the driving pipe 11 closer to or further away from the conveyor line 1, whereby the distance between each of the first spray nozzle assemblies 7 and the work or heat exchanger 5 being sprayed is controlled.

As shown in FIG. 1, each of the first spray nozzle assemblies 7 is so disposed in the precoating zone 2 as to spray the water-soluble paint on the fins of the heat exchanger in a direction parallel to the fins when the heat exchanger 5 to be painted halts in a position facing each of the groups of the first spray nozzle assemblies 7. In the embodiment of the present invention shown in FIG. 1, though the first spray nozzle assemblies 7 are disposed as described above, it is also possible that each of the first spray nozzle assemblies 7 is so disposed as to spray the water-soluble paint in a direction slightly deviated to the downstream side of the conveyor line 1. In spraying, it is necessary for each of the first spray nozzle assemblies 7 to spray the water-soluble paint in a direction parallel to major axes of cross sections of the flattened tubes 74 of the heat exchanger 5 being painted. Consequently, in FIG. 1, in case that the major axes of the cross sections of the flattened tubes 74 of the heat exchanger 5 suspended from the conveyor line 1 are not perpendicular to the conveyor line 1, since each of the first spray nozzle assemblies 7 is movably mounted on the driving pipe 11 through the suitable swivel joint (not shown) as described above, it is possible to adjust the first spray nozzle assemblies 7 in spraying direction so as to be aligned with these major axes of the cross sections of the flattened tubes 74 of the heat exchanger 5.

Of these four first spray nozzle assemblies 7, adjacent assemblies 7 closely spaced apart from each other are formed into groups of two as shown in FIG. 1, so that the groups of the assemblies 7 are spaced apart from each other at predetermined intervals along the conveyor line 1. In the embodiment of the present invention shown in FIG. 1, two adjacent first spray nozzle assemblies 7 constituting each of the groups spray the water-soluble paint on one side of the heat exchanger 5. However, it is preferably to vary the number of the first spray nozzle assemblies 7 of each of the groups within a range of from one to a few according to the size of the heat exchanger 5 being painted.

A first group of the first spray nozzle assemblies 7 disposed in an upstream side of the precoating zone 2 along the conveyor zone 1 spray the water-soluble paint on one side of the heat exchanger 5. Subsequently, a second group of the first spray nozzle assemblies 7 disposed in a downstream side of the precoating zone 2 along the conveyor line 1 spray the water-soluble paint on the other side of the heat exchanger 5 to complete precoating of the heat exchanger 5. In spraying, the heat exchanger 5 is turned 180° by means of the rotating means 13 at a position between these two groups of the first spray nozzle assemblies 7 in the precoating zone 2 while conveyed along the conveyor line 1. As shown in FIG. 1, the rotating means 13 is disposed along the conveyor line 1.

Figure 2:
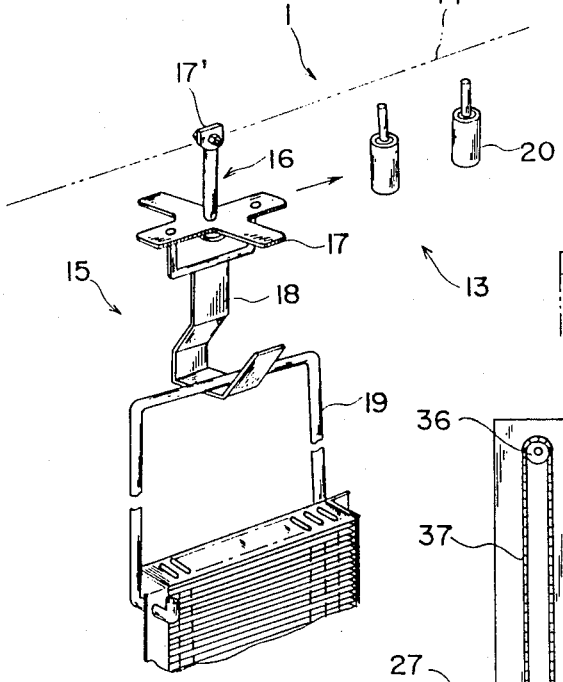
FIG. 2 is a schematic perspective view of a work holder or suspension means essentially constructed of a supporting member for suspending the heat exchanger from the conveyor line and a rotating means for turning the heat exchanger 180°.

As shown in FIG. 2, the conveyor line 1 is constructed of a suitable conveyor means such as an endless conveyor chain 14. The work holder or suspending means 15 is rotatably suspended from the endless conveyor chain 14 through the supporting member 16 which is provided with a cylindrical portion having a top hook 17'. The top hook 17' of the supporting member 16 is bolted to the endless conveyor chain 14 so that the supporting member 16 of the suspending means or work holder 15 is connected to the conveyor chain 14. As shown in FIG. 2, a lower portion of the supporting member 16 of the work holder 15 is rotatably mounted in a central portion of the rotating arm 17 of the work holder 15. The rotating arm 17 of the work holder 15 is provided with branch portions assuming a cross-shaped form in plan view as is clear from FIG. 2. Fixed to the rotating arm 17 is the work hook 18 on which is hung the supporting frame 19 for suspending the work or heat exchanger 5 therefrom.

As shown in FIG. 2, the rotating means 13 disposed along the conveyor line 1 is constructed of a pair of rollers 20 spaced apart from each other at predetermined intervals along the conveyor line 1. In operation, when the work holder or suspending means 15 is conveyed along the conveyor line 1 in a direction indicated by an arrow in FIG. 2, the cross-shaped branch portions of the rotating arm 17 of the work holder 15 are sequentially brought into contact with the pair of the rollers 20 to turn the rotating arm 17 ninety degrees (90°) each time the branch portion of the rotating arm 17 is brought into contact with the roller 20, whereby the rotating arm 17 is finally rotated 180° by the pair of the rollers 20. As a result, in the precoating zone 2, the opposite sides of the work or heat exchanger 5 are painted with the water-soluble paint by sprays issued from the groups of the first spray nozzle assemblies 7. In the embodiment of the painting system of the present invention shown in FIG. 1, the precoating zone 2 is followed by a pair of the air-blow zones 3 in each of which is provided the air-blow means 21. Essentially, the number of the air-blow zone 3 may be one. In the embodiment of the present invention shown in FIG. 1, the number of the air-blow zone 3 is two so that more effect of the air blow is expected.

As shown in FIG. 1, each of the air-blow means 21 is provided with eight air-blow nozzle assemblies 22 each of which is mounted on the driving pipe 11 in the same manner as that of each of the first spray nozzle assemblies 7 of the first spray means 6, so that each of the air-blow nozzle assemblies 22 is vertically reciprocated in the same manner as that of each of the first spray nozzle assemblies 7 when the driving pipe 11 is swingably operated in a vertical plane by the driving means 10. Each of the air-blow nozzle assemblies 22 is connected to a flexible hose (not shown) so as to be supplied with a compressed air through such flexible hose.

The heat exchanger 5 having been painted with the water-soluble paint by spray in the precoating zone 2 enters the air-blow zone 3 in which is disposed the air-blow means 21 provided with the air-blow nozzle assemblies 22 for driving the currents of air upon the fins of the heat exchanger 5 in parallel to the fins. Each of the air-blow nozzle assemblies 22 is movably mounted on the driving pipe 11 so as to be adjustable in its spray direction as in each of the first spray nozzle assemblies 7.

Of eight air-blow nozzle assemblies 22 of the air-blow means 21, adjacent four are formed into a group so that a pair of groups of the assemblies 22 are formed in each of the air-blow zones 3. These groups of the assemblies 22 are spaced apart from each other at a predetermined interval along the conveyor line 1. In a preceding one of the air-blow zones 3, one side of the heat exchanger 5 coated with the water-soluble paint is subjected to air blow from one of the groups of the air-blow nozzle assemblies 22, and then the other side of the heat exchanger 5 is subjected to air blow from the other group of the air-blow nozzle assemblies 22 so that the opposite sides of the heat exchanger 5 are entirely subjected to the air blows. The number of the air-blow nozzle assemblies 22 in the group may vary within a range of from one to a few according to the size of the heat exchanger 5 being subjected to the air blow, as is in the case of the first spray nozzle assemblies 7.

Interposed between the pair of the groups of the air-blow nozzle assemblies 22 is the rotating means 13*a* having the same construction as that of the rotating means 13 interposed between the pair of the groups of the first spray nozzle assemblies 7. By means of such rotating means 13*a*, the heat exchanger 5 is turned 180° in the preceding air-blow zone 3 so that the opposite sides of the heat exchanger 5 coated with the water-soluble paint are separately subjected to air blow.

In the embodiment of the present invention shown in FIG. 1, the preceding air-blow zone 3 is followed by a trailing one of the air-blow zones 3. In this case, an additional rotating means 13*b* is interposed between the preceding one and the trailing one of the air-blow zones 3 so that the heat exchanger 5 passed through the preceding air-blow zone 3 is further turned 180° before it enters the trailing air-blow zone 3, whereby the same air blow operation as that conducted in the preceding air-blow zone 3 is repeated in the trailing air-blow zone 3 by means of another air-blow means 21 provided in the trailing air-blow zone 3. Namely, in the trailing air-blow zone 3, the another air-blow means 21 is also provided with a pair of groups of the air-blow nozzle assemblies 22. In the trailing air-blow zone 3, interposed between the pair of the groups of the air-blow nozzle assemblies 22 is further another rotating means 13*c* by which the heat exchanger 5 is turned 180° so that the opposite sides of the heat exchanger 5 are repeatedly subjected to air blow from the pair of the groups of the air-blow nozzle assemblies 22.

The trailing air-blow zone 3 is followed by the electrostatic spraying zone 4 provided with the second spray means 23 which is essentially constructed of: a pair of second spray nozzle assemblies 24; an airless pump 25 for supplying the solvent-soluble paint to each of the second spray nozzle assemblies 24; and a flexible paint hose 26 through which the airless pump 25 communicates with each of the second spray nozzle assemblies 24.

In the electrostatic spraying zone 4, the heat exchanger 5 having being subjected to air blow halts in front of a preceding one of the second spray nozzle assemblies 24, which one sprays the solvent-soluble paint on the fins of the heat exchanger 5 in parallel to the fins through electrostatic spraying.

One side of the heat exchanger 5 is painted by the electrostatic spraying from the preceding one of the second spray nozzle assemblies 24. After that the heat exchanger 5 is turned 180° by the rotating means 13*d* interposed between the preceding one and the trailing one of the second spray nozzle assemblies 24, and then the other side of the heat exchanger 5 is painted by the electrostatic spraying from a trailing one of the second spray nozzle assemblies 24 so that the opposite sides of the heat exchanger 5 are separately painted by electrostatic spraying from the preceding one and the trailing one of the second spray nozzle assemblies 24.

In operation, each of the second spray nozzle assemblies 24 is vertically reciprocated by the driving means 27 in the substantially same manner as that of each of the first spray nozzle assemblies 7 driven by the driving means 10. Namely, each of the second spray nozzle assemblies 24 is movably mounted on the driving pipe 28 of the driving means 27. The distance between each of the second spray nozzle assemblies 24 and the heat exchanger 5 suspended from the conveyor line 1 is controlled by turning the handle 29 of the driving means 27. The solvent-soluble paint is supplied to each of the second spray nozzle assemblies 24 through each of the flexible hoses 26.

Each of the second spray nozzle assemblies 24 mounted on the driving pipe 28 is electrically insulated from the driving pipe 28 while supplied with a high-tension current from a high-tension generator (not shown). On the other hand, the conveyor line 1 is grounded so that the heat exchanger 5 suspended from the conveyor line 1 is also grounded. In electrostatic spraying, a high-tension current of for example from 50 to 70 kilovolts is supplied to each of the second spray nozzle assemblies 24 while the work or heat exchanger 5 is grounded, so that the solvent-soluble paint sprayed from each of the second spray nozzle assemblies 24 is charged with an electric potential of from such 50 to 70 kilovolts. As a result, the sprayed paint particles, on leaving each of the nozzle assemblies 24, are electrically attracted to the heat exchanger 5 which is grounded, so that electrostatic spraying of the heat exchanger 5 is accomplished. In order to discharge the sprayed paint particles not attracted to the heat exchanger 5 to the outside of the painting system of the present invention shown in FIG. 1, it is preferable to provide the wetted wall or water-wash wall 4*a* in the electrostatic spraying zone 4. The water-wash wall 4*a* is oppositely disposed from the second spray nozzle assemblies 24 so as to recover the sprayed paint particles reaching the water-wash wall or wetted wall 4*a*.

Figure 3:
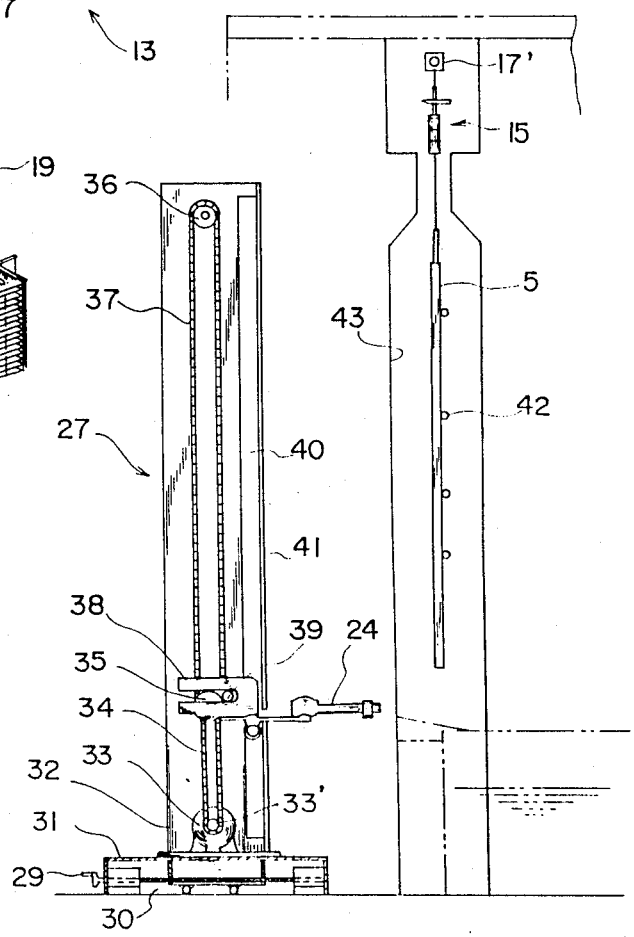
FIG. 3 is a partial cross-sectional view of the embodiment of the present invention shown in FIG. 1, taken along the line III—III of FIG. 1.

The driving means 27 is illustrated in detail in FIG. 3. As shown in FIG. 3, in the driving means 27, the base member 30 is provided with the traveling carriage 32. By turning the handle 29 of the base member 30, it is possible to horizontally move the carriage 32. In a bottom portion of the traveling carriage 32 is provided a geared motor 33 which is of an adjustable-speed type. An output shaft of the motor 33 is provided with a motor-output sprocket 33'. An intermediate sprocket 35 is provided in the traveling carriage 32 at a position spaced apart from the geared motor 33 so that the primary endless chain 34 runs round the motor-output sprocket 33' and the intermediate sprocket 35. In an upper portion of the traveling carriage 32 is provided an upper sprocket 36 so that a secondary endless chain 37 runs round the intermediate sprocket 35 and the upper sprocket 36. A supporting member 38 is connected to the secondary endless chain 37 through a pin 39. Each of the second spray nozzle assemblies 24 is mounted on the driving pipe 28 (not shown in FIG. 3) which is mounted on the supporting member 38. Incidentally, the supporting member 38 is slidably mounted in the guide rail 40 so as to be moved up and down while kept horizontal. Consequently, when the geared motor 33 is actuated, each of the second spray nozzle assemblies 24 is repeatedly moved up and down in a reciprocating manner.

In order to prevent the sprayed paint particles issued from the second spray nozzle assemblies 24 from entering the driving means 27, a front portion of the traveling carriage 32 is covered with the wall member 41 which is provided with slits through which the second spray nozzle assemblies 24 extend outward toward the work or heat exchanger 5 suspended from the conveyor line 1. Each of the slits of the wall member 41 may be covered with a flexible sheet such as a rubber sheet having a vertical cut.

The heat exchanger 5 suspended from the work holder or suspension means 15 is prevented from swinging during spraying and air blowing by means of a guide bar 42 provided in parallel to the conveyor line 1. One side of the heat exchanger 5 is painted with the solvent-soluble paint by electrostatic spraying conducted by the preceding one of the second spray nozzle assemblies 24, which one moves up or down during the electrostatic spraying. A traveling speed of each of the second spray nozzle assemblies 24 in its up-and-down movement is for example about 50 m/minute. Each of the first spray nozzle assemblies 7 and the air-blow nozzle assemblies 22 is also moved up and down at the substantially same speed as that of each of the second spray nozzle assemblies 24.

Incidentally, in FIG. 3, vertical wall members 43, which are disposed at right angles to the heat exchanger 5, may be partitions interposed between the air-blow zone 3 and the electrostatic spraying zone 4.

Although the first spray nozzle assemblies 7 of the first spray means 6, air-blow nozzle assemblies 22 of the air-blow means 21 and the second spray nozzle assemblies 24 of the second spray means 23 are vertically moved in their service zone 2, 3 and 4 by the driving means 10 and 27 in the embodiment of the present invention shown in FIG. 1, it is also possible to obtain the same effects as those of the above movable nozzle assemblies 7, 22 and 24 by replacing these movable nozzle assemblies 7, 22 and 24 with a plurality of stationary nozzle assemblies vertically arranged in rows each of which is constituted by the required number of stationary nozzle assemblies for covering the entire area of one side of the heat exchanger 5 being painted.

In FIG. 1, water-wash walls or wetted walls 44 and 45 are provided in positions oppositely disposed from the first spray means 6 and the air-blow means 21 in the precoating zone 2 and the air-blow zone 3, respectively, so that the sprayed particles of the water-soluble paint not attracted to the heat exchanger 5 adhere to the wetted walls 44 and 45. Namely, the heat exchanger 5 suspended from the conveyor line 1 is interposed between these nozzle assemblies 7, 22 and such wetted walls 44, 45 to make it possible that the sprayed paint particles not attracted to the heat exchanger 5 adhere to the wetted walls 44, 45.

In order to recover the sprayed water-soluble paint adhered to the wetted walls 44 and 45, the scraper means 46 and 47 are provided in the precoating zone 2 and the air-blow zone 3, respectively. The paint adhered to the wetted walls 44 and 45 is scraped downward by the scraper means 46 and 47, respectively, so as to be collected in the paint-recovering tank 31. The thus recovered paint is returned to the airless pump 8 for re-use through a suitable transfer means, if necessary. The vapor of the thus recovered water-soluble paint in an upper portion of the paint-recovering tank 31 is discharged to the outside of the painting system of the present invention shown in FIG. 1 through suitable ventilating ducts 48 and 49, and then appropriately processed. Incidentally, it is preferable that these ventilating ducts 48 and 49 are in communication with both of the precoating zone 2 and the air-blow zone 3 so as to discharge the vapors produced in these zones 2 and 3 to the outside of the painting system of the present invention shown in FIG. 1.

Figure 4:
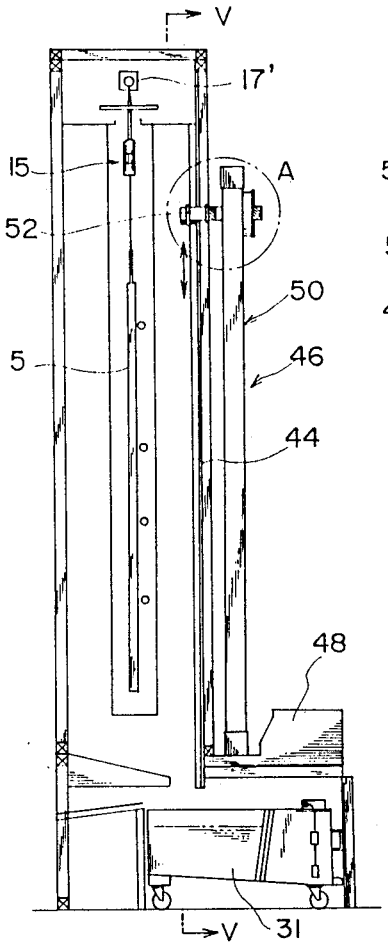
FIG. 4 is a partial cross-sectional view of the embodiment of the present invention shown in FIG. 1, taken along the line IV—IV of FIG. 1.
Figure 5:
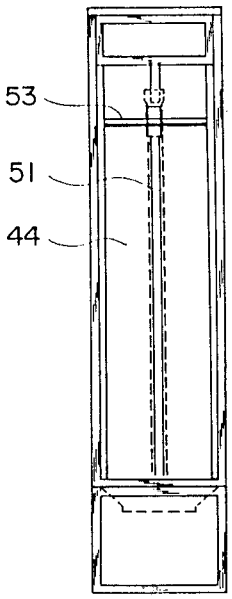
FIG. 5 is a longitudinal sectional view of the embodiment of the present invention shown in FIG. 1, taken along the line V—V of FIG. 4.

In FIGS. 4 to 8, the scraper means 46 provided in the precoating zone 2 for scraping the paint sprayed from the first spray means 6 is shown in detail. The scraper means 47 provided in the air-blow zone 3 for scraping the water-soluble paint blown by the the air-blow means 21 has the substantially same construction as that of the scraper means 46 so that description of the scraper means 47 is neglected to avoid redundancy in description. As shown in FIGS. 4 and 5, the scraper means 46 comprises: a pneumatic driving unit 50; a rod 52 which is moved up and down by the driving unit 50 while passed through a vertical slit 51 of the wall member 44 to which the sprayed water-soluble paint not received by the heat exchanger 5 is adhered; and the scraper 53 mounted on a front-end portion of the rod 52.

On the other hand, the paint-recovering tank 31 is disposed under the wall member 44 to receive the sprayed water-soluble paint scraped by the scraper 53.

Figure 6:
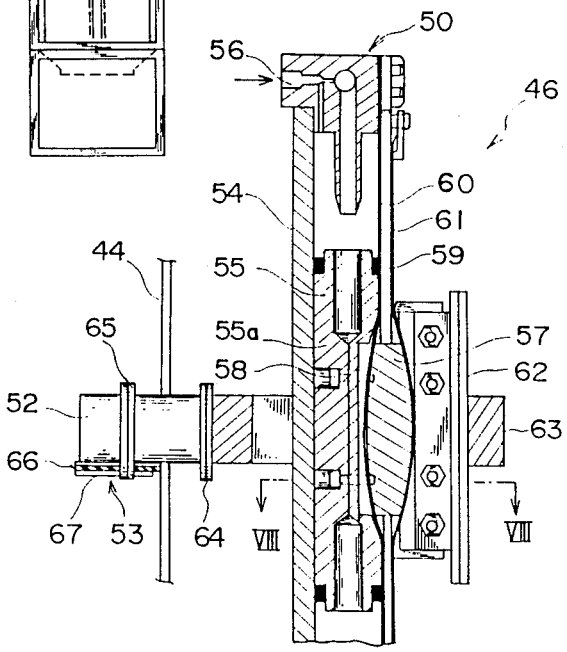
FIG. 6 is an enlarged sectional view of a portion of the embodiment of the present invention shown in FIG. 1, the portion being indicated by the reference character "A" in FIG. 4.
Figure 7:
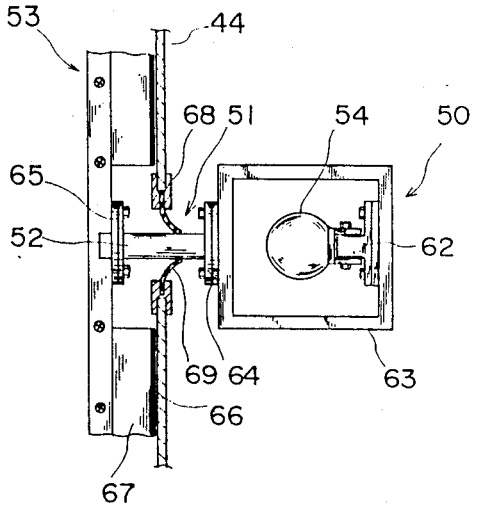
FIG. 7 is an enlarged plan view of the portion "A" of the embodiment of the present invention shown in FIG. 4.
Figure 8:
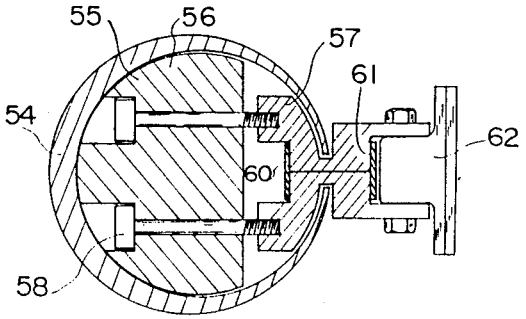
FIG. 8 is a sectional view of the embodiment of the present invention shown in FIG. 1, taken along the line VIII—VIII of FIG. 6.

FIG. 6 is an enlarged sectional view of a portion of the embodiment of the present invention shown in FIG. 1, the portion being indicated by the reference character "A" in FIG. 4, and FIG. 7 is an enlarged plan view of the portion "A" of the embodiment of the present invention shown in FIG. 4. As shown in FIGS. 6 and 7, the driving unit 50 is constructed of a rodless pneumatic cylinder or band-sealing type air cylinder. The driving unit 50 is provided with a cylinder 54 in which is slidably mounted a piston 55 which is moved up and down in the cylinder 54 under the influence of a compressed air supplied to the cylinder 54 through its air-inlet openings 56 provided in opposite ends of the cylinder 54, the compressed air being supplied from a suitable outer compressed-air source (not shown) through a suitable pneumatic control circuit.

As shown in FIG. 6, the piston 55 of the driving unit 50 is constructed of a piston axle 55*a* and a two-piece type piston yoke 57 bolted to the piston axle 55*a*. Such bolted portion of the piton yoke 57 is shown in detail in cross section in FIG. 8. As is clear from FIG. 8, the cylinder 54 of the driving unit 50 is provided with an axial slit through which the piston yoke 57 is projected outward from the cylinder 54. Sealing of spaces defined between the cylinder 54 and the piston axle 55*a* is established by: O-rings 59 mounted on the opposite ends of the piston axle 55*a* so as to be sandwiched between the cylinder 54 and the piston axle 55*a*; an inner sealing band 60 so mounted inside the piston yoke 57 as to axially extend; and an outer sealing band 61 so mounted outside the piston yoke 57 as to axially extend.

To an outer extension portion of the piston yoke 57 is bolted a flange member 62 to which is bolted a side of a square-shaped hollow connecting member 63. As is clearly shown in FIG. 7, the cylinder 54 of the driving unit 50 is surrounded by the connecting member 63. To the other side of the connecting member 63 opposite the above side bolted to the flange member 62 is bolted a flange portion 64 of the rod 52. The other end of the rod 52 is formed into a flange portion 65 to which the scraper 53 is connected. As is clear from FIGS. 6 and 7, the scraper 53 is provided with a pair of rubber plates 66 each of which is clamped between a pair of metallic plates 67 by means of clamping bolts so that a front edge portion of each of the rubber plates 66 extends outward from edges of the metallic plates 67, whereby such front edge portion of each of the rubber plates 66 is brought into contact with the wall member 44.

As is clear from FIG. 7, a pair of vertical supporting members 68 are mounted on each of vertical side portions of the vertical slit 51 formed in the wall member 44. Clamped between these pairs of the supporting members 68 is a vertical resilient sheet 69 made of a suitable material such as rubber. The thus clamped vertical resilient sheet 69 is provided with a vertical central cut through which the rod 52 passes outward so as to pass through the slit 51 of the wall member 44, whereby the resilient sheet 69 substantially prevents the sprayed water-soluble paint from passing through the slit 51 of the wall member 44. Even when a small amount of the sprayed water-soluble paint passes through the slit 51 of the wall member 44, there is substantially no fear that such small amount of the sprayed water-soluble paint passed through the slit 51 adversely affects the piston 55 movably mounted in the cylinder 54 of the driving unit 50 in operation since a slit formed in the cylinder 54 of the driving unit 50 is not oppositely disposed from the slit 51 of the wall member 44.

In operation, the embodiment of the painting system of the present invention shown in FIG. 1 is controlled through a control panel 70 so that: the conveyor line 1 is moved intermittently as it is controlled; the airless pump 8 of the first spray means 6 is operated as it is controlled; the first spray nozzle assemblies 7 of the first spray means 6 are intermittently operated as they are controlled; the air-blow nozzle assemblies 22 of the air-blow means 21 are intermittently operated as they are controlled; the driving means 10 of the air-blow means 21 is actuated as it is controlled; the airless pump 25 of the second spray means 23 is operated as it is controlled; the second spray nozzle assemblies 24 of the second spray means 23 are intermittently operated during electrostatic spraying as they are controlled; the driving means 27 of the second spray means 23 is actuated as it is controlled; and the scraper means 46, 47 are operated as they are controlled. Incidentally, detecting the conveyed heat exchanger 5 suspended from the conveyor line 1 to issue a detection signal of the heat exchanger 5 to the following stage and starting the operation of the following stage upon receipt of such detection signal are easily accomplished by anyone skilled in the art according to a conventional method, for example with the aid of computers, so that description of these processes are neglected to avoid redundancy in description.

Now, essential operations of the painting system of the present invention shown in FIG. 1 will be described with reference to FIGS. 9 and 10.

Figure 9:
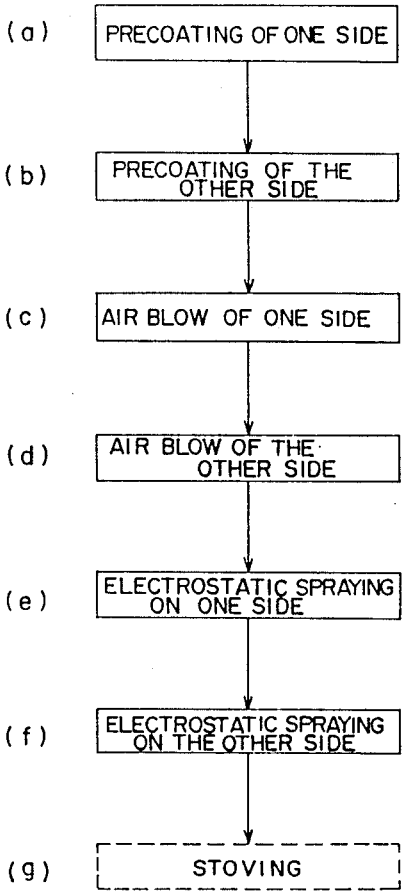
FIG. 9 is a block flow diagram showing an example of a painting process conducted by the embodiment of the present invention shown in FIG. 1, in which process the heat exchanger is painted.

Each of the works or heat exchangers 5 suspended from the conveyor line 1 at predetermined intervals sequentially enters the precoating zone 2 and halts in front of the preceding group of the first spray nozzle assemblies 7 of the first spray means 6 so that one side of the heat exchanger 5 is precoated with the water-soluble paint when the preceding group of the first spray nozzle assemblies 7 is moved up and down in a first stage (FIG. 9(*a*)) of the painting process shown in FIG. 9. FIGS. 10(*a*)–(*f*) are partial sectional views of fins of the heat exchanger to be painted, which diagrammatically and sequentially illustrate the painting process shown in FIG. 9 conducted by the embodiment of the present invention shown in FIG. 1. The water-soluble paint 79 sprayed on the plate fins 73 of the heat exchanger 5 in parallel to the fins 73 by means of the preceding group of the first spray nozzle assemblies 7 adheres to the fins 73 as shown in FIG. 10(*a*). It is preferable that the water-soluble paint 79 adhered to the fins 73 forms drops which bridge gaps between the fins 73. The water-soluble paint may be "Aqua No. 9500 HP Black" which is a trade name of a product produced by Nihon Yushi Kabushiki Kaisha. The "Aqua No. 9500 HP Black" essentially consists of a water-soluble polyester resin vanish mixed with a 20% alcohol solvent or water, and has a viscosity of 78 cP (centipoise).

Figure 10:
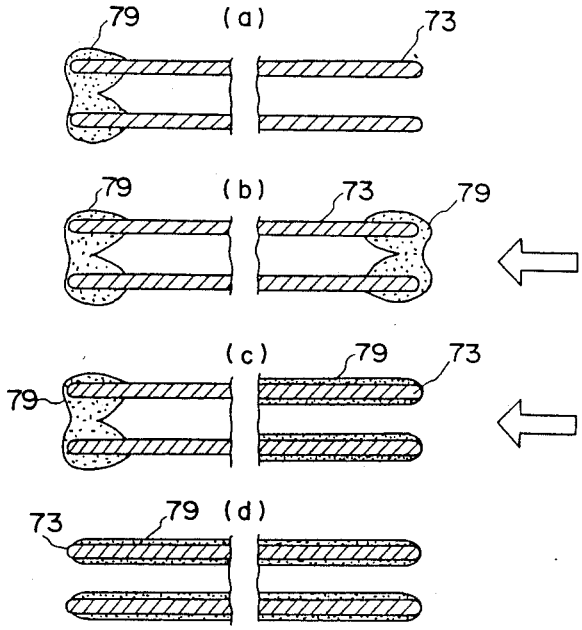
FIGS. 10(*a*)–(*f*) are partial sectional views of fins of the heat exchanger to be painted, which diagrammatically and sequentially illustrate the painting process shown in FIG. 9 conducted by the embodiment of the present invention shown in FIG. 1.

Now, the heat exchanger 5 one side of which has been precoated is turned 180° by means of the rotating means 13 in the precoating zone 2 shown in FIG. 1, and then the trailing groups of the first spray nozzle assemblies 7 spray with the water-soluble paint 79 on the other side of the heat exchanger 5 while being moved up and down (FIG. 9(*b*) and FIG. 10(*b*)).

After completion of precoating, the heat exchanger 5 enters the air-blow zone 3 in which one side or the above-mentioned other side of the heat exchanger 5 is subjected to air blow from the preceding groups of the air-blow nozzle assemblies 22 of the air-blow means 21 (FIG. 9(*c*) and FIG. 10(*c*)), the preceding group of the air-blow nozzle assemblies 22 being moved up and down during the air blow. After that, the heat exchanger 5 is turned 180° by means of the rotating means 13*a* so that the other side of the heat exchanger 5 is then subjected to air blow from the trailing group of the air-blow nozzle assemblies 22 (FIG. 9(*d*) and FIG. 10(*d*)), the trailing group of the air-blow nozzle assemblies 22 being moved up and down during the air blow. As a result, the fins 73 of the heat exchanger 5 is uniformly precoated with the water-soluble paint 79 as shown in FIG. 10(*c*). The air-blown water-soluble paint precoated on the fins 73 form a precoating film which entirely covers even the root portions of the fins 73 and the outer peripheral surfaces of the flattened tubes 74 of the heat exchanger 5. During the air blow on the other side of the heat exchanger 5, there is no fear that the water-soluble paint coating on the one side of the heat exchanger 5 is blown off since the currents of air issued from the trailing group of the air-blow nozzle assemblies 22 rapidly lose their energies until the currents of air reach the fin ends of the one side of the heat exchanger 5.

In the embodiment of the painting system of the present invention shown in FIG. 1, the above-mentioned air blow is repeated in the following stage so that the description of such following air blow stage is neglected to avoid redundancy in description. Such neglect is also made in FIGS. 9 and 10 to avoid redundancy in description.

The heat exchanger 5 then enters the electrostatic spraying zone 4 in which one side of the heat exchanger is first subjected to electrostatic spraying from the preceding one of the second spray nozzle assemblies 24 of the second spray means 23 (FIG. 9(*e*) and FIG. 10(*e*)), which preceding assembly 24 is moved up and down during electrostatic spraying. After completion of electrostatic spraying on the one side of the heat exchanger 5, the heat exchanger 5 is brought into contact with the rotating means 13*d* so that the exchanger 5 is turned 180° by the rotating means 13*d*, and then the other side of the heat exchanger 5 is subjected to electrostatic spraying from the trailing one of the second spray nozzle assemblies 24 moved up and down during electrostatic spraying (FIG. 9(*f*) and FIG. 10(*f*)), whereby the opposite sides of the heat exchanger 5 is entirely painted with the solvent-soluble paint through the electrostatic spraying. The reasons why the electrostatic spraying is required in the painting system of the present invention is that: after completion of the air blows, the water-soluble paint coated on edge portions of the fins 73 is substantially removed from these edge portions to make the fins 73 poor in rust resistance or corrosion resistance at their edge portions so that it is necessary to coat these edge portions of the fins 73 with the solvent-soluble paint 80 sufficiently through the electrostatic spraying.

In the electrostatic spraying zone 4, the particles of the solvent-soluble paint charged with the electrical potential of for example from 50 to 70 kilovolts are attracted to the heat exchanger 5, which is grounded, so as to be concentrated in metallic surfaces of the edge portions of the fins 73 of the grounded heat exchanger 5 as shown in FIGS. 10(*e*) and (*f*). However, since the total area of the metallic surfaces of the edge portions of the fins 73 is very small, an amount of the solvent-soluble paint consumed in the electrostatic spraying is very little relative to that of the water-soluble paint consumed in precoating. The solvent-soluble paint employed in the painting system of the present invention may be "Anti-rust Black TR" which is a trade name of a product produced by Nihon Yushi Kabushiki Kaisha. The "Anti-rust Black TR" is essentially consists of a special denatured alkyd resin varnish mixed with suitable solvents such as ketones and alcohols, and has a viscosity of 40 centipoises.

After completion of electrostatic spraying, the heat exchanger 5 enters the stoving zone shown in FIG. 9(*g*) in which the paint coatings formed on the heat exchanger 5 are stoved.

Since the painting system of the present invention has the above construction, it is possible to paint uniformly and efficiently even the root portions of the closely spaced fins 73 of the heat exchanger 5.

In the painting system of the present invention, the substantially entire surface of the heat exchanger 5 is coated with the water-soluble paint 79 by spraying as shown in FIG. 9(*d*), and the metallic surfaces of the heat exchanger 5 still not coated with the water-soluble paint 79 after spraying is coated with the solvent-soluble paint 80 by electrostatic spraying as shown in FIGS. 10(*e*) and (*f*). Consequently, in the painting system of the present invention, a relatively large amount of the water-soluble paint which is easily recovered is employed during spraying, while a relatively small amount of the solvent-soluble paint which is a difficult paint to recover is consumed during electrostatic spraying. This is an advantage inherent in the painting system of the present invention.

What is claimed is:

1. A painting system for painting a finned-tube heat exchanger provided with a plurality of fins so mounted on tubes of said heat exchanger as to be closely spaced apart from each other, comprising:

(i) a conveyor line from which said heat exchanger is suspended so as to be conveyed by said conveyor line;

(ii) a first spray means provided with a first spray nozzle assembly for spraying a water-soluble paint on said fins of said heat exchanger in a direction parallel to said fins, which heat exchanger suspended from said conveyor line halts during spraying of said water-soluble paint;

(iii) an air-blow means provided with an air-blow nozzle assembly for driving a current of air upon said fins of said heat exchanger in a direction parallel to said fins, which heat exchanger having been sprayed with said water-soluble paint halts during driving of said current of air;

(iv) a second spray means provided with a second spray nozzle assembly for spraying a solvent-soluble paint on said fins of said heat exchanger in a direction parallel to said fins through electrostatic spraying, which heat exchanger having been blown with said current of air halts during electrostatic spraying of said solvent-soluble paint;

(v) a wall means oppositely disposed from each of said first spray means and said air-blow means so as to receive said water-soluble paint having sprayed and passed through said heat exchanger; and (vi) a scraper means for scraping said water-soluble paint received by said wall means to recover said water-soluble paint.

2. The painting system as set forth in claim 1, wherein:

said scraper means is provided with: a driving unit; a rod member which is moved up and down by said driving unit, while passed through a vertical slit formed in a wall member which receives said water-soluble paint sprayed but not adhered to said heat exchanger; and a scraper mounted on a front-end portion of said rod.

3. The painting system as set forth in claim 1, wherein:

each of said first spray means, said air-blow means, said second spray means forms a pair adjacently disposed along said conveyor line so that one of said pair is used in treating one side of said heat exchanger while the other one of said pair is used in treating the other side of said heat exchanger, said conveyor line being connected with a suspension means for rotatably suspending said heat exchanger therefrom, while a rotating means for turning said heat exchanger 180° being interposed between said pair.

* * * * *